US005860601A

United States Patent [19]

Egizi

[11] Patent Number: 5,860,601

[45] Date of Patent: Jan. 19, 1999

[54] FUEL INJECTOR NEEDLE TIP

[75] Inventor: Lisa Egizi, Newport News, Va.

[73] Assignee: Siemens Automotive Corporation, Auburn Hills, Mich.

[21] Appl. No.: 745,401

[22] Filed: Nov. 8, 1996

[51] Int. Cl.[6] ..... F02M 61/00

[52] U.S. Cl. ..... 239/533.12; 239/585.5; 29/890.143

[58] Field of Search ..... 239/533.2, 533.3, 239/533.12, 584, 585.4, 585.5; 29/890.142, 890.143

[56] References Cited

U.S. PATENT DOCUMENTS 2,746,800 5/1956 Voit ..... 239/584

4,907,745 3/1990 Messingschlager ..... 239/585.5 X

FOREIGN PATENT DOCUMENTS 3129427 2/1983 Germany ..... 239/533.12

2204357 11/1983 United Kingdom ..... 239/585.5

*Primary Examiner*—Andres Kashnikow

*Assistant Examiner*—Steven J. Ganey

[57] ABSTRACT

A fuel injector needle has a separate pin element fixed in an axial bore in a tip end of the needle, the bore surrounded by an annular partially spherical region sealing to a valve seat. The pin element is separately manufactured and has a conical spray pattern shaping feature at one end protruding from the needle tip. The annular region can be accurately formed and finished prior to installation of the pin element.

4 Claims, 1 Drawing Sheet

FUEL INJECTOR NEEDLE TIP

BACKGROUND OF THE INVENTION

This invention concerns fuel injectors for internal combustion engines. Fuel injection has become the preferred mode of delivering fuel charges to the cylinders of engines used in automobiles and trucks.

Fuel injectors typically include a thin elongated valve element commonly referred to as a valve "needle", which has a partially spherical tip, the tip engaging a conical seat when the injector is closed to prevent fuel from being injected into the engine from the injector until the injector is opened. Energizing an injector solenoid operator causes the needle to be lifted from the seat when fuel is to be injected, allowing fuel under pressure to be discharged through an aligned opening in the seat, and through an orifice in a plate below the valve seat. The orifice influences the shape of a spray pattern formed when the pressurized fuel discharges from the injector tip.

The shape and surface finish of the needle tip is critical for proper operation of the injector, primarily because the tip must very reliably establish a sealing engagement with the valve seat whenever the solenoid is deenergized.

The tip end initially is ground to a partially spherical shape. A "superfinishing" procedure is then conducted to reliably achieve proper sealing of each fuel injector tip on its seat. The superfinishing is carried out using a very fine grit stone and a compliant mounting of the needle to achieve a submicron surface finish.

Current multivalve engines employ injectors which divide the discharge into two distinct spray patterns, each directed at a respective intake valve associated with a given engine cylinder. This dual spray pattern is achieved by an orifice disc having two orifice openings and by a modification of the partially spherical needle tip, comprised of a conical spray-shaping feature extending from the center of the tip. Other spray pattern affecting features are also possible.

The spray-shaping feature has been difficult to form while carrying out shaping and superfinishing of the annular region of the spherical needle tip which engages the conical valve seat.

It is the object of the present invention to provides a fuel injector needle tip which enables a central spray pattern shaping feature to be provided on the tip while allowing a properly finished annular valve seat engaging region on the needle tip.

SUMMARY OF THE INVENTION

According to the present invention, the fuel injector needle tip end is first ground into a partially spherical shape.

The needle tip has an axial bore machined into the center of the partially spherical surface to leave an annular, partially spherical region extending around the bore, this region configured to sealingly engage the valve seat. The annular region is thereafter superfinished to insure proper sealing engagement with the valve seat.

A separate pin element is separately manufactured which has one end configured with the desired spray pattern shaping feature.

The pin element is inserted into the axial bore and permanently secured therein with the one end projecting out of the center of the tip from within the annular region.

This manufacturing process allows the critical valve seat engaging surface to be very accurately formed and properly finished, while providing the spray pattern feature projecting from the center of the tip.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
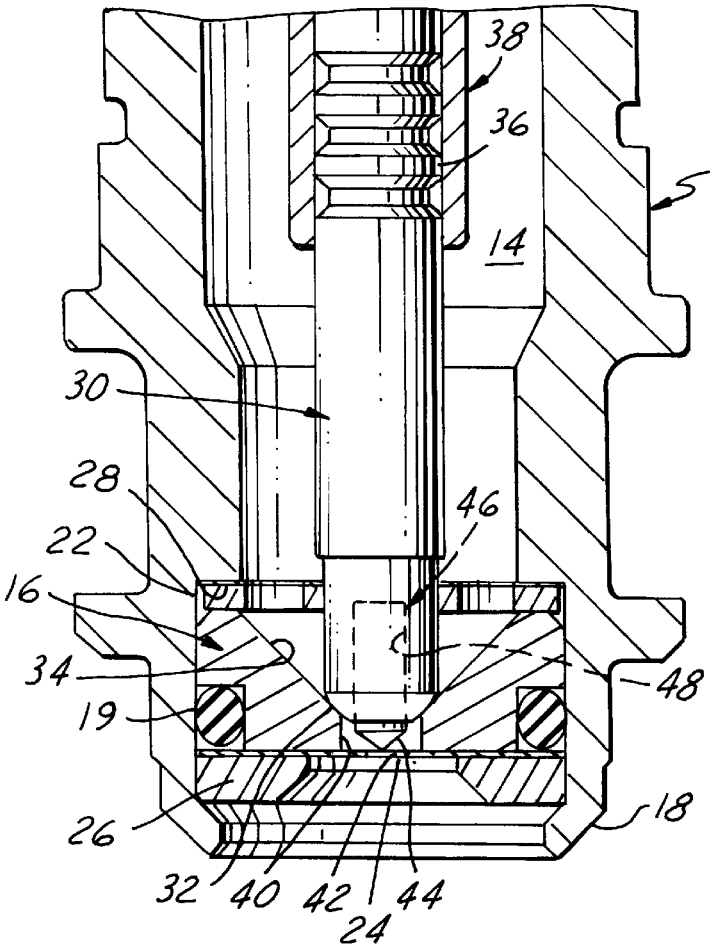
FIG. 1 is an enlarged partially sectional view of the end portion of a fuel injector, showing the details of a fuel injector tip manufactured by the method of the present invention, and the associated valve seat and orifice disc.

Referring to FIG. 1, a tip end portion of a fuel injector 10 is shown. A complete fuel injector of the type with which the present invention can be used is shown in U.S. Pat. No. 5,494,225 issued to the assignee of the present application on Feb. 27, 1996 for a "Shell Component to Protect Injector From Corrosion".

The injector 10 includes a generally tubular valve body 12 having an inner fuel passage 14 receiving fuel under pressure from a fuel rail (not shown) in which the injector 10 is installed. A valve seat member 16 is held in the valve body 12 by a crimp 18 at the tip end of the valve body 12.

A filter screen 20, valve guide 22, valve seat 16, orifice disc 24, and backup washer 26 are stacked together and held against a shoulder 28 formed in fuel passage 14 of the valve body 12 by the crimp 18. An O-ring seal 19 seals the outer diameter of the seat 16 to the inside of the valve body 12.

An elongated fuel injector valve needle 30 extends longitudinally through the fuel passage 14, having a tip 32 which is spring urged into engagement with a conical seat 34 formed in the valve seat member 16, as shown.

The upper end 36 of the needle 30 is crimped into an armature 36 which is moved upwardly when an operator solenoid is energized, overcoming the spring pressure and unseating the needle tip 32. This allows a discharge of pressurized fuel through a valve seat bore 40 and through one or more orifices 42 in the orifice disc 24.

Other details of the injector 10 are not here described inasmuch as such injectors are well known and described in detail in the above-referenced U.S. Pat. No. 5,494,225.

The needle tip surface 32 is partially spherical, and an annular region thereof makes sealing contact with the conical seat 34. The shape and surface finish of surface 32 is known to be critical to insure that no fuel leakage occurs when the tip is seated.

A fuel spray shaping conical feature 44 projects axially from within the annular needle tip surface 32 so as to be positioned to affect the spray pattern formed by the fuel discharging past the tip surface 32 and out through bore 40 and orifice 42.

According to the concept of the present invention, the spray shaping feature 44 is provided by a separate pin element 46 assembled to the needle 30 by being secured in an axial bore 48 machined into the tip.

Referring to FIGS. 2A–2D, the tip of the needle 30 is initially formed with a partially spherical shape. Next, the axial bore 48 is machined into the tip leaving an annular partially spherical surface 32, which engages the conical seat surface 34.

This annular region is then finished by known techniques to a submicron surface finish. Such techniques involve a compliant mounting of the needle 30 while grinding with a fine grit stone. This "superfinishing" should be done after machining the axial bore 48 so that distortion of the surface 32 which might be caused by machining of the bore 48 is avoided.

Figure 2A:
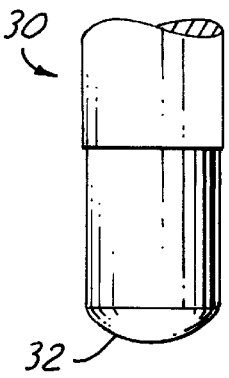
FIG. 2A is a fragmentary side elevational view of a fuel injector needle tip shown after the needle tip is formed with a partially spherical shape.
Figure 2B:
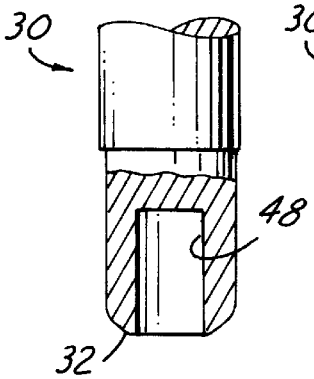
FIG. 2B is a fragmentary,, partially sectional view of a fuel injector needle in which an axial bore has been machined into the partially spherical tip of the needle.
Figure 2C:
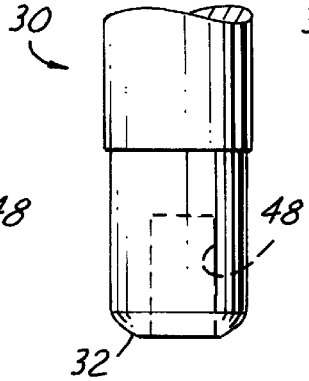
FIG. 2C is a fragmentary view of the fuel injector needle with an axial bore machined thereinto as shown in FIG. 2B, together with a separately machined pin element having one end configured in the shape of a spray pattern shaping feature.
Figure 2C:
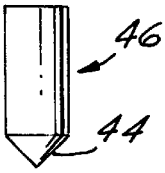
Figure 2D:
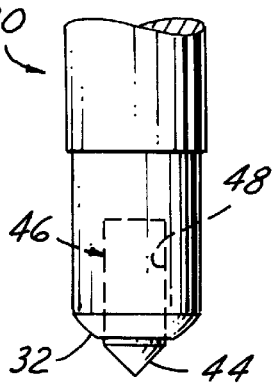
FIG. 2D is a fragmentary view of the fuel injector needle having the pin element installed in the axial bore in the fuel injector needle.

The pin element 46 is separately manufactured, with a conical feature 44 at one end comprising one form of the spray pattern shaping feature, as shown in FIG. 2C.

Finally, the shank of the pin element 44 is fit into the needle bore 48 and permanently secured therein, as by laser welding. The conical spray pattern shaping feature 44 protrudes axially from within the annular surface 32 so as to be impinged by discharging fuel.

The spray shaping feature 44 can be of any of several shapes which will produce a particular desired spray pattern without interfering with the needle tip forming and superfinishing processes.

I claim:

1. A method of manufacturing a fuel injector needle comprising the steps of:

forming a partially spherical surface on a tip at one end of said needle;

forming an axial bore into said tip to leave an annular region on said partially spherical tip surface;

superfinishing said annular region after forming said axial bore;

separately forming a pin element having a spray pattern shaping feature at one end and a shank at the other end adapted to be fit into said bore; and, fitting said pin element shank into said axial bore, and permanently securing said shank therein with said spray pattern shaping feature protruding from within said annular region on said tip surface.

2. The method according to claim 1 wherein said spray pattern shaping feature comprises a conical surface on said pin element one end.

3. A fuel injector needle for controlling fuel flow through a valve seat having a conical seat surface for sealingly engaging a tip at one end of said injector needle, said needle having an annular partially spherical surface formed on said needle tip, said fuel injector made by the process of:

forming the annular partially spherical surface on the tip at one end of said needle;

forming said axial bore into said tip to leave an annular region on said annular partially spherical tip surface;

superfinishing said annular region after forming said axial bore;

separately forming said pin element having said spray pattern shaping tip feature at one end and said shank at the other end adapted to be fit into said axial bore; and, fitting said pin element shank into said axial bore after superfinishing said annular region, and permanently securing said shank therein with said spray pattern shaping tip feature protruding from within said annular region on said annular partially spherical tip surface.

4. The fuel injector needle according to claim 3 wherein said pin element protruding tip has a conical shape.

* * * * *